US005604331A

United States Patent [19]

Matarin et al.

[11] Patent Number: 5,604,331

[45] Date of Patent: Feb. 18, 1997

[54] FIREPROOF SHEATH AND METHOD FOR MAKING SAME

[75] Inventors: Didier Matarin, Saint Marcel; Charles Maillard, Notre-Dame-de-l'Isle; Guy Gaillard, Anet; Michel Peltot, Pontoise, all of France

[73] Assignees: Societe Europeenne de Propulsion, Suresnes; Labinal, Le Bretonneux, both of France

[21] Appl. No.: 406,949

[22] PCT Filed: Jul. 27, 1994

[86] PCT No.: PCT/FR94/00941

§ 371 Date: Mar. 29, 1995

§ 102(e) Date: Mar. 29, 1995

[87] PCT Pub. No.: WO95/04358

PCT Pub. Date: Feb. 9, 1995

[30] Foreign Application Priority Data

Jul. 30, 1993 [FR] France ..... 93 09406

[51] Int. Cl.[6] ..... H01B 7/18

[52] U.S. Cl. ..... 174/121 A; 174/124 GC; 174/122 R

[58] Field of Search ..... 174/124 R, 124 GC, 174/121 A, 122 R, 72 A; 87/7

[56] References Cited

U.S. PATENT DOCUMENTS

| | | | |
|---|---|---|---|
| Re. 30,414 | 10/1980 | Kinoshita | 423/447.6 |
| 3,900,701 | 8/1975 | Bayles et al. | 174/102 R |
| 4,051,324 | 9/1977 | Anderson et al. | 174/121 R |
| 4,312,260 | 1/1982 | Morieras | 174/121 R |
| 5,075,514 | 12/1991 | Hurd | 174/117 F |
| 5,227,586 | 7/1993 | Beauchamp | 174/122 R |

FOREIGN PATENT DOCUMENTS

| | | | |
|---|---|---|---|
| 1515626 | 8/1969 | Germany | 174/72 A |
| 2948031 | 6/1981 | Germany . | |
| WO9207366 | 4/1992 | WIPO . | |

*Primary Examiner*—Kristine L. Kincaid
*Assistant Examiner*—Marc D. Machtinger
*Attorney, Agent, or Firm*—Weingarten, Schurgin, Gagnebin & Hayes LLP

[57] ABSTRACT

The present invention relates to a method of thermally and mechanically protecting cables and bundles of cables by use of a sheath braided directly around the element to be protected using a braiding yarn constituted by a plurality of elementary strands formed by interlacing synthetic fibers obtained after cracking and spinning an aramid fiber and a carbonizable oxidized organic fiber. The carbonizable oxidized organic fiber constitutes the major portion of the synthetic fibers making up the elementary strand for the braiding yarn. The invention also provides a thermal and mechanical protective sheath for cables and bundles of cables obtained by the method. In order to improve certain mechanical or thermal characteristics of the sheath, it may be associated with a material made of a fiber additional to said two synthetic fibers, in order to form the elementary strand, or indeed the sheath braided in this way may itself be covered in additional braiding based on aramid fibers.

15 Claims, 3 Drawing Sheets

FIREPROOF SHEATH AND METHOD FOR MAKING SAME

BACKGROUND OF THE INVENTION

The invention relates to an anti-fire sheath intended mainly for providing cabling with mechanical protection and with thermal protection in the event of a fire, in particular for use in the fields of aviation, space, and industry. The invention also relates to a method of making the sheath.

In certain conditions of use, cables or cable harnesses providing electrical connections within mechanical or electronic units are liable to be subjected for a greater or lesser length of time to high temperatures exceeding those specified by the manufacturers of the products concerned. In most cases, that causes the connections to be interrupted which can lead directly or indirectly to the equipment concerned being destroyed. In space applications, the loss of one essential function can abort the entire mission with consequent financial loss, and in the field of aviation, the failure of essential equipment such as emergency lighting, for example, can be a direct cause of loss of human life in the event of an aircraft crashing.

At present, the techniques used for providing cables with thermal protection are essentially of three kinds:

for aviation applications, such temperature protection is provided by placing the various cable paths in cold zones that are specially designed to withstand such high temperatures. Such a solution, in addition to being very expensive since it requires complex cooling systems, is not really effective as has been demonstrated by the latest analyses of recent aircraft accidents. In addition, in the engine environment of aircraft, the cables passing through zones that are at risk are special cables already having a fireproof rating, that are very expensive, and that have high mass and bulk per unit length;

in space applications, the ability to withstand temperature is provided during final assembly of the equipment by covering the cables and cable harnesses in a flexible spiral type protective covering based on a "Jehier" type material or in a more rigid protective covering based on silica or glass fibers, such as "Reprobat". However, those solutions require considerable time to be implemented and they are particularly expensive and penalizing as to weight. In addition, the first kind of protective covering is effective up to about 200° C. only, while the second suffers from a baking effect caused by the capacity of the fibers to absorb heat. In addition, protective coverings based on silica or glass fibers require special precautions in use given their toxicity; and in industrial applications, it is common practice to use special cables that have a fireproof rating, in particular cables based on PTFE and having operating temperatures that may be as high as 300° C. to 400° C. However since such high quality cables are very expensive, there can be no question of making bundles of cables using that technique.

None of the above solutions is entirely satisfactory, since they do not enable the needs of users to be optimized with respect to mass, cost, maximum temperature, and time required for implementation.

Thus, a search for novel solutions has been undertaken by the French company Aérospatiale, starting from thermal screens based on materials having low transmissivity in the infrared and commonly used in firefighting. For example, such screens are sold by the company Ariégeoise de Bonneterie, of Montferrier (09), France, under the name MONSEGUR. That search has led to French patent application No. FR 2 666 048 which sets out to protect a material based on a superpostion of MONSEGUR fabric sheets and covered on each face with a layer of silicone. Unfortunately that novel thermal protection is still not satisfactory since, as in the prior art, it can only be implemented on final assembly of the equipment. Further, it remains heavy, expensive, and difficult to implement, and by its very structure it is not adapted to protecting a single cable having a diameter of a few millimeters. It should also be observed that given the significant stiffness of the material (because of its multiple layers and because of its silicone covering), it is very poorly adapted to cabling that has numerous twists and turns, as is often the case in rocket engines.

At present, there does not exist any protection for cabling that has good mechanical strength, that is effective at temperatures of greater than 400° C., for example, and that is simultaneously cheap, lightweight, and compact, while also being capable of being fitted to cabling of any shape or size.

SUMMARY OF THE INVENTION

The object of the present invention is thus to mitigate the above drawbacks and to provide very high temperature (up to about 850° C.) protection for all kinds of cabling, cables, and cable harnesses, which protection is universal in that it can be implemented in any type of industry, and in particular as a replacement for present-day space coverings and certain cold protections for aviation. Another object of the invention is to provide a sheath that is not complex to install on the assembly site. Yet another object of the invention is to provide such thermal and mechanical protection very compactly.

These objects are achieved by a thermal and mechanical protective sheath for cables and bundles of cables, the sheath being obtained by direct braiding around the element to be protected, comprising a braided layer of braiding yarns made of a plurality of elementary strands formed by interlacing synthetic fibers obtained after cracking and spinning an aramid fiber and a carbonizable oxidized organic fiber.

By means of this entirely novel use of synthetic fibers that have previously been used solely in the form of woven cloth in flameproof panels, it is possible to obtain universal protection for any type of activity, that is of a cost that is very low both as to materials costs and as to installation cost (any on-site protection is pointless). In addition, the low mass per unit length and the associated compactness of such a sheath make it particularly suitable for any on-board application. The protection can be implemented on ordinary cables and also on optical fiber cables, thereby giving them quite exceptional performance mechanically, thermally, and against fire. It may be observed that such a sheath is also applicable to pneumatic or hydraulic systems.

Tests performed under various measurement conditions (types of cable, bundle diameters) have demonstrated the exceptional performance of the sheath of the invention.

For a flame temperature of 727° C. (at the surface of the sheath), no measurement loss (continuity and insulation maintained) was observed for more than 15 minutes on bundles of cables having a diameter of more than 10 mm. On single cables of the 4 FE type or thermocouple cable, no measurement loss was observed for 10 minutes.

Such performance goes well beyond the specifications presently laid down, particularly for space applications, and demonstrates the advantages of the sheath of the invention. In addition, it is worth observing that protection for 25 bundles comprising about 150 cables (mean length 6 meters) weighs only 1 kg to 2 kg, which is to be compared with about ten kilograms for equivalent prior art protection.

The sheath of the invention can be implemented to comprise one or more braided layers superposed on the initial layer, and the braiding configurations of the various layers may be different.

When there are severe constraints concerning pollution, the sheath preferably includes an additional layer for eliminating the fiber residues that come from the cracking operation. Various tests have shown that a layer constituted by a braid based-on aramid fibers such as Nomex is suitable in most applications.

BRIEF DESCRIPTION OF THE DRAWINGS

Other characteristics and advantages of the present invention appear better from the following description given by way of non-limiting indication and with reference to the accompanying drawings, in which.

DESCRIPTION OF THE PREFERRED EMBODIMENTS

Figure 1:
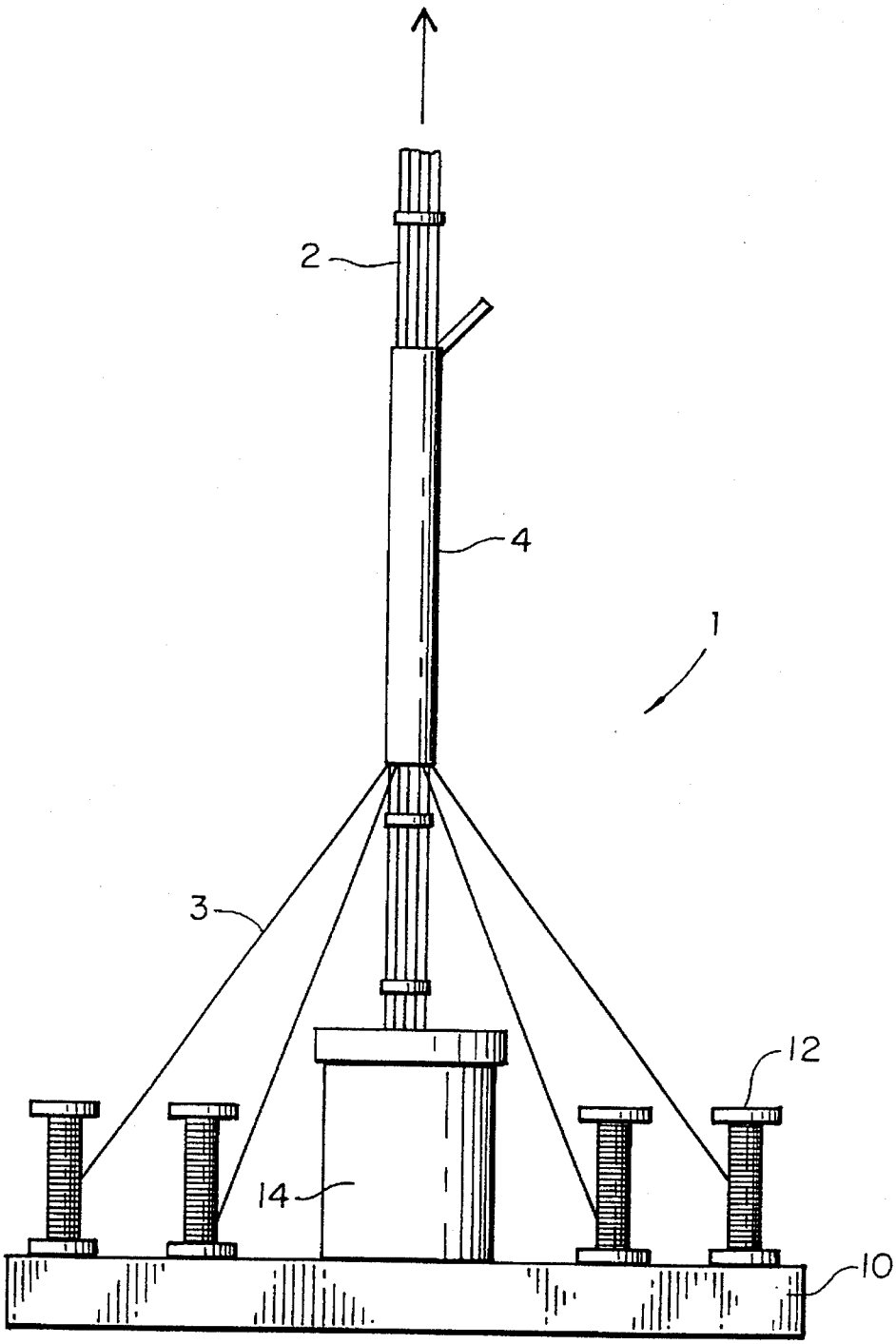
FIG. 1 is a diagram showing a braiding machine for making a thermal protection sheath of the invention.

FIG. 1 is a diagram of a braiding machine for braiding a thermal protection sheath of the invention. Such a machine 1 conventionally comprises a support 10 carrying yarn feed spools 12 and a feed well 14 that delivers the element 2 that is to receive the braiding. The braiding yarn 3 present on the various feed spools is braided directly around the element to be protected 4 as it leaves the well of the braiding machine. This element may be constituted by a single cable of arbitrary diameter, with present braiding machines being suitable for braiding sheaths having a diameter in the range 2 mm to more than 40 mm, or else the element can be constituted by a bundle of cables, as shown in FIGS. 2 and 3.

In the context of the present invention, the braiding yarn is constituted by a plurality of elementary strands that are made up by interlacing synthetic fibers obtained after cracking and spinning an aramid fiber and a carbonizable oxidized organic fiber. The aramid fiber has very good mechanical characteristics and withstands heat excellently (it may be a product known under one of the following names: "Kevlar", "Twaron", or "Technora"). The carbonizable oxidized organic fiber, in particular a fiber based on polyacrylonitrile, is a known fiber, e.g. under the name "Sigrafil". After cracking, these two fibers respectively contribute 30% and 70% in the manufacture of an elementary strand on which the braiding yarn is based. This preferred ratio does not exclude other ratios providing the larger amount is oxidized organic fiber.

In some applications, in order to form the elementary strand, it may be necessary to associate the previously obtained synthetic fiber with another fiber having special characteristics adapted to the application. For example, if it is desired to improve the thermal properties of the sheath with respect to conduction, then it can be particularly advantageous to use a material which has good thermal resistivity, for example, in addition to the above-specified synthetic fiber. It should be observed that adding a material as additional yarn may be performed during braiding by loading one or more feed spools with the special material, while the other spools receive the synthetic material derived of the initial treatment.

A first layer of thermal protection is then obtained merely by braiding the previously made-up braiding yarn at a determined braiding angle and using a predefined number of spools. Where required, one or more additional layers may be braided over the first layer, at the same braiding angle or at a different angle.

In applications where pollution constraints are severe, e.g. in space applications, it may be necessary to cover the thermal protection layer or layers with an additional layer for eliminating the whiskers present on the synthetic fiber that comes from the cracking process. Such anti-pollution protection can readily be achieved by additional braiding using an aramid yarn such as Nomex. Similarly, it is also possible to envisage special impregnation of the sheath, for example, for proofing it against trickling liquids. Another solution that does not require the use of an additional layer, consists in cleaning the elementary strands prior to any braiding (e.g. by combing).

These various superposed layers, or possibly the single layer when thermal and pollution constraints are less severe, thus form a sheath around the element that is to be protected, which element may be a single cable or a bundle of cables, and the cabling then requires no further manipulation other than being installed in the device on which it is to be mounted. No further special thermal mechanical protection step needs to be implemented during final assembly of the equipment. Thus, at present, at least 150 hours are required on-site for integrating the thermal protection provided on the cabling in a rocket engine of the latest generation.

The various steps enabling a thermal protection sheath to be made for cables and for bundles of cables are as follows:

a) elementary strands are made from a predetermined number of synthetic fibers obtained after cracking and spinning determined proportions of an aramid fiber and of a preoxidized fiber;

b) these strands are mounted on a predetermined number of spools or spindles for feeding a braiding machine with yarn; and c) the protective sheath is made from the feed spools by braiding the yarns at a predetermined angle directly around the cable or the bundle of cables to be protected.

In some applications, braiding step c) is repeated at least one more time, optionally using a braiding configuration that differs from the preceding configuration.

When cable installation requires special severe anti-pollution specifications, the method includes an additional step in order to eliminate the fiber residues due to the cracking operation:

d) consisting either in covering the sheath braided in this way with an additional layer of some other yarn that is clean-room compatible, of the "Nomex" type, or else in special impregnation of the braided sheath, the impregnation providing proofing against trickling liquids with which the sheath may come into contact. An alternative solution exists whereby an additional step is interposed between steps a) and b), consisting in combing the elementary strands, thereby cleaning the yarn prior to braiding.

Figure 2A:
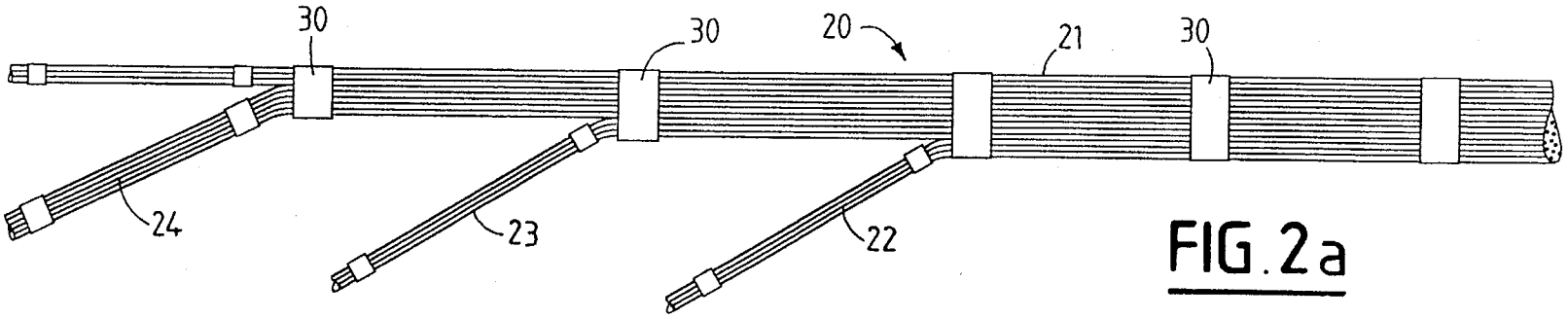
FIGS. 2*a* to 2*c* and 3*a* to 3*c* show two examples of how the method of making sheaths of the invention can be implemented.
Figure 2B:
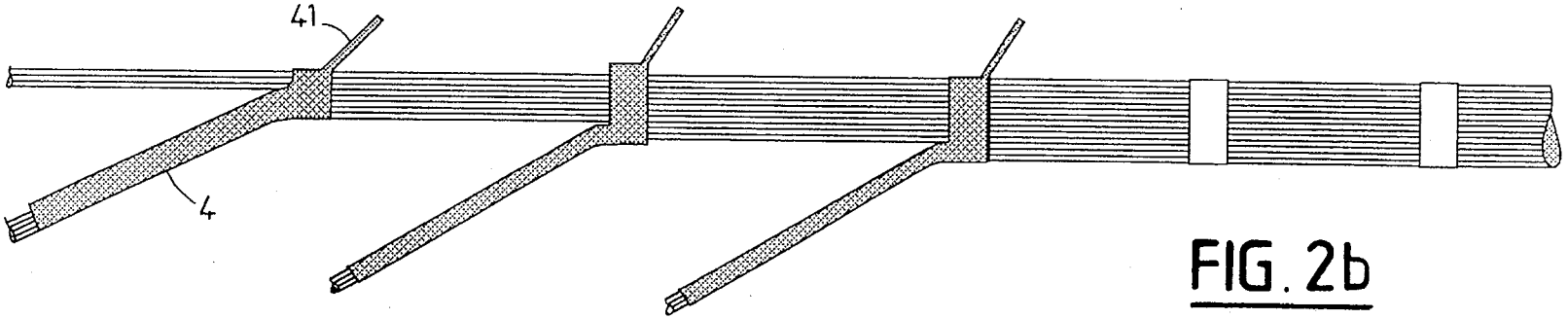
Figure 2C:
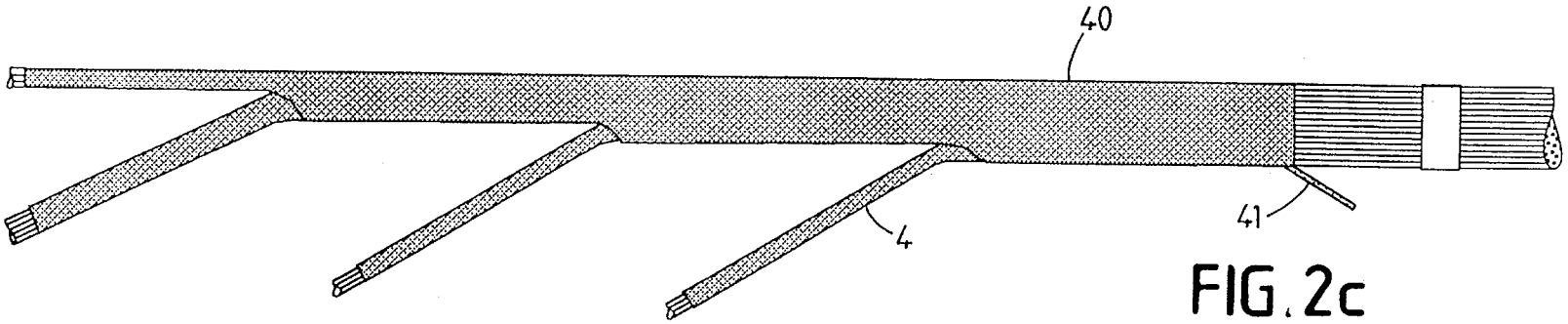
Figure 3A:
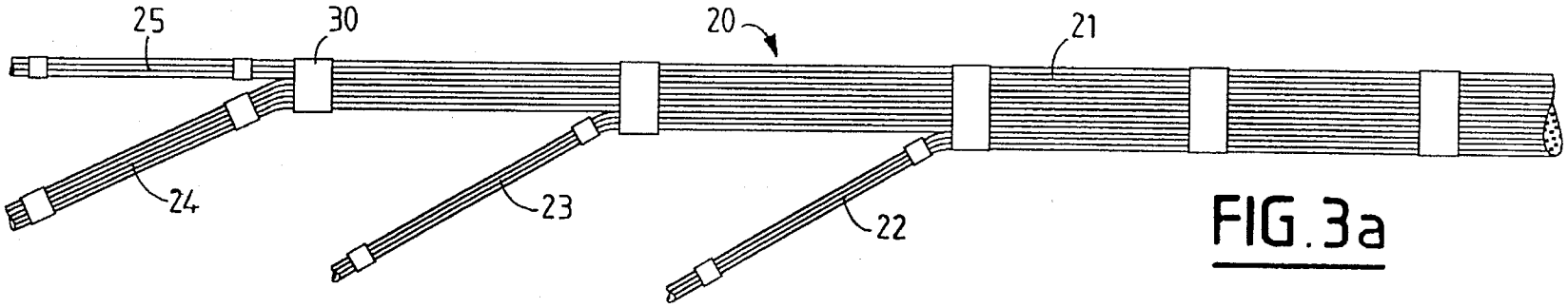

FIGS. 2*a* to 2*c* and 3*a* to 3*c* show two implementations of a sheath being braided to surround a bundle of cables 20 comprising a main length 21 and various auxiliary branches 22, 23, 24 that attach thereto so as to form forks with the main length (see FIGS. 2*a* and 3*a*).

In the first implementation as shown in FIGS. 2*a* to 2*c*, the auxiliary branches are initially braided so as to be covered with respective sheaths 4, the braiding being performed in such a manner as to cover support accessories 30 (tapes, bindings, etc.) disposed at junctions with the main length. Thereafter, the main length can be braided in a single pass, with its sheath 40 then covering portions of the earlier braiding that overlie the support tapes. The element referenced 41 corresponds to a "braiding tail" which may be used for fixing the sheath to a support structure.

Figure 3B:
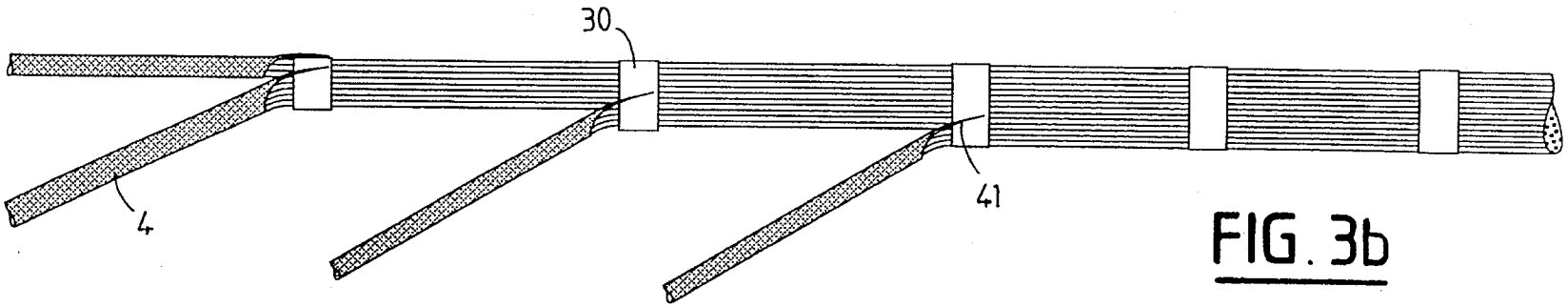
Figure 3C:
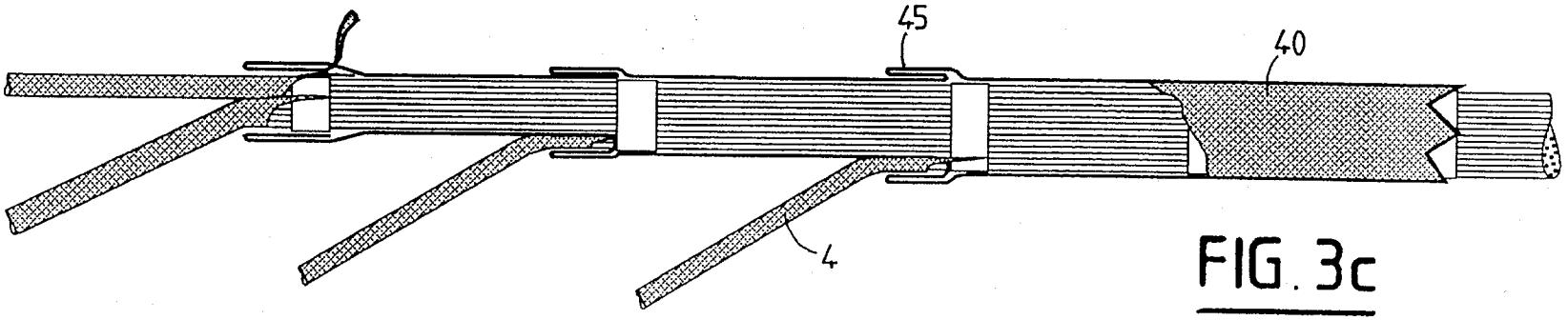

In the second implementation shown in FIGS. 3*a* to 3*c*, only the free ends of the bundle of cables are covered in braid during an initial step, i.e. only the auxiliary branches 22 to 24 and the end of the main length 25 are covered in braid. Thereafter, the main length 21 is covered in braid that overlies the as yet unprotected portions of the bundle of cables, with overlap flaps 45 being formed at the junctions of the auxiliary branches so as to ensure maximum overlap without any gaps in the braiding.

Naturally, the above two specific implementations are not limiting in any way and more conventional techniques may also be implemented without going beyond the ambit of the invention.

We claim:

1. A method of thermally and mechanically protecting cables and bundles of cables comprising:

providing braiding yarn comprising a plurality of elementary strands comprising interlaced synthetic fibers obtained after cracking and spinning an aramid fiber and a carbonizable oxidized organic fiber; and braiding the braiding yarn directly around an element to be protected to provide a sheath.

2. A method according to claim 1, characterized in that the step of providing braiding yarn comprising a plurality of elementary strands comprises providing for the elementary strands interlaced synthetic fibers having a major portion of carbonizable oxidized organic fiber.

3. A method according to claim 1, characterized in that the step of providing braiding yarn comprising a plurality of elementary strands comprises using for the elementary strands a material made of an additional fiber associated with the aramid fiber and the carbonizable oxidized organic fiber.

4. A method according to claim 3, characterized in that the step of using a material made of an additional fiber comprises choosing a material that improves the thermal characteristics of the protection with respect to conduction.

5. A method according to claim 1, characterized in that the cable further comprises another layer formed by a braid of aramid fibers surrounding the sheath.

6. A thermal and mechanical protective sheath for cables and bundles of cables comprising:

a layer of braiding yarn directly braided around an element to be protected, the braiding yarn comprising a plurality of elementary strands comprising interlaced synthetic fibers obtained after cracking and spinning an aramid fiber and a carbonizable oxidized organic fiber.

7. A thermal and mechanical protective sheath for cables and bundles of cables according to claim 6, characterized in that it comprises one or more first additional braided layers superposed on the initial layer, the braiding configurations of the various layers optionally being different.

8. A thermal and mechanical protective sheath for cables and bundles of cables according to claim 6, characterized in that it includes an additional layer for eliminating fiber residues due to the cracking operation.

9. A thermal and mechanical protective sheath for cables and bundles of cables according to claim 8, characterized in that the additional layer is braided using aramid fibers forming yarns that are braided.

10. A thermal and mechanical protective sheath for cables and bundles of cables according to claim 8, characterized in that the additional layer is made by specially impregnating the sheath for the purpose of further proofing it against trickling liquids.

11. A method according to claim 2, characterized in that the step of providing braiding yarn comprising a plurality of elementary strands comprises using for the elementary strands a material made of an additional fiber associated with the aramid fiber and the carbonizable oxidized organic fiber.

12. A thermal and mechanical protective sheath for cables and bundles of cables according to claim 7, characterized in that it includes a second additional layer for eliminating fiber residues due to the cracking operation.

13. A method according to claim 2, further comprising the step of providing a second layer around the element to be protected formed by a braid of aramid fibers surrounding said sheath.

14. A method according to claim 3, further comprising the step of providing a second layer around the element to be protected formed by a braid of aramid fibers surrounding said sheath.

15. A method according to claim 4, further comprising the step of providing a second layer around the element to be protected formed by a braid of aramid fibers surrounding said sheath.

* * * * *